US005770840A

United States Patent [19]

Lorence

[11] Patent Number: 5,770,840

[45] Date of Patent: Jun. 23, 1998

[54] MICROWAVE COOKING CONTAINER FOR FOOD ITEMS

[75] Inventor: Matthew W. Lorence, Omaha, Nebr.

[73] Assignee: Conagra Frozen Foods, Omaha, Nebr.

[21] Appl. No.: 818,904

[22] Filed: Mar. 17, 1997

Related U.S. Application Data

[63] Continuation of Ser. No. 570,756, Dec. 12, 1995, abandoned.

[51] Int. Cl.[6] ..... H05B 6/80

[52] U.S. Cl. ..... 219/730; 219/759; 426/107; 426/234; 426/243; 99/DIG. 14

[58] Field of Search ..... 219/730, 729, 219/759; 426/107, 109, 234, 241, 243; 99/DIG. 14

[56] References Cited

U.S. PATENT DOCUMENTS

| | | |
|---|---|---|
| Re. 34,829 | 1/1995 | Stone . |
| 2,600,566 | 6/1952 | Moffett . |
| 2,714,070 | 7/1955 | Welch . |
| 2,830,162 | 4/1958 | Copson et al. . |
| 3,219,460 | 11/1965 | Brown . |
| 3,751,629 | 8/1973 | Eisler . |
| 3,829,654 | 8/1974 | Eisler . |
| 3,854,023 | 12/1974 | Levinson . |
| 3,966,972 | 6/1976 | Theimer et al. . |
| 3,985,990 | 10/1976 | Levinson . |
| 4,110,587 | 8/1978 | Souder, Jr. et al. . |
| 4,190,757 | 2/1980 | Turpin et al. . |
| 4,267,420 | 5/1981 | Brastad . |
| 4,306,133 | 12/1981 | Levinson . |
| 4,345,133 | 8/1982 | Cherney et al. . |
| 4,351,997 | 9/1982 | Mattisson et al. . |
| 4,390,555 | 6/1983 | Levinson . |
| 4,399,157 | 8/1983 | Caporaso . |
| 4,416,907 | 11/1983 | Watkins . |
| 4,425,368 | 1/1984 | Watkins . |
| 4,448,791 | 5/1984 | Fulde et al. . |
| 4,499,356 | 2/1985 | Hatagawa . |
| 4,567,341 | 1/1986 | Brown . |
| 4,590,349 | 5/1986 | Brown et al. . |
| 4,592,914 | 6/1986 | Kuchenbecker . |
| 4,594,492 | 6/1986 | Maroszek . |
| 4,626,641 | 12/1986 | Brown . |
| 4,641,005 | 2/1987 | Seiferth . |
| 4,661,672 | 4/1987 | Nakanaga . |
| 4,663,506 | 5/1987 | Bowen et al. . |
| 4,703,148 | 10/1987 | Mikulski et al. . |
| 4,713,510 | 12/1987 | Quick et al. . |
| 4,735,513 | 4/1988 | Watkins et al. . |
| 4,735,812 | 4/1988 | Bryson et al. . |
| 4,806,718 | 2/1989 | Seaborne et al. . |
| 4,808,780 | 2/1989 | Seaborne . |
| 4,810,845 | 3/1989 | Seaborne . |
| 4,814,568 | 3/1989 | Keefer . |
| 4,818,831 | 4/1989 | Seaborne . |
| 4,825,025 | 4/1989 | Seiferth . |
| 4,836,439 | 6/1989 | Hart ..... 219/730 |
| 4,841,112 | 6/1989 | Peleg . |
| 4,866,232 | 9/1989 | Stone . |
| 4,870,233 | 9/1989 | McDonald et al. . |
| 4,876,427 | 10/1989 | Mode ..... 219/730 |
| 4,882,184 | 11/1989 | Buckholz et al. . |
| 4,882,463 | 11/1989 | Kyougoku et al. . |
| 4,906,806 | 3/1990 | Levinson . |
| 4,916,279 | 4/1990 | Brown et al. . |
| 4,917,907 | 4/1990 | Kwis et al. . |
| 4,923,704 | 5/1990 | Levinson . |
| 4,927,991 | 5/1990 | Wendt et al. . |

(List continued on next page.)

*Primary Examiner*—Philip H. Leung
*Attorney, Agent, or Firm*—Pretty, Schroeder & Poplawski

[57] ABSTRACT

A container for cooking and browning pot pies and similar food items in a microwave oven is disclosed. The container has a susceptor layer positioned between the top panel and the pot pie. A pan for containing a food item and having a susceptor lining for further cooking and browning the food item is located below the susceptor layer. The arrangement of susceptor layer in connection with the pan provide for the desired degree of cooking and browning the food item without the need to remove the food item from the transporting container.

14 Claims, 2 Drawing Sheets

U.S. PATENT DOCUMENTS 4,933,193 6/1990 Fisher ..... 219/730
4,935,592 6/1990 Oppenheimer .
4,968,522 11/1990 Steinke et al. .
4,968,865 11/1990 Seaborne et al. .
4,970,360 11/1990 Pesheck et al. .
4,972,059 11/1990 Wendt et al. .
5,002,789 3/1991 Graf et al. .
5,019,680 5/1991 Morino et al. ..... 219/730
5,028,754 7/1991 Chiba .
5,030,468 7/1991 Van Lengerich et al. .
5,035,904 7/1991 Huang et al. .
5,043,173 8/1991 Steinke et al. .
5,045,330 9/1991 Pawlowski .
5,053,594 10/1991 Thota et al. .
5,069,918 12/1991 Graf et al. .
5,089,278 2/1992 Haynes et al. .
5,117,078 5/1992 Beckett .
5,118,514 6/1992 Adams et al. .
5,173,580 12/1992 Levin et al. .
5,183,787 2/1993 Seaborne .
5,194,271 3/1993 Yasosky .
5,230,914 7/1993 Akervik .
5,239,153 8/1993 Beckett .
5,258,194 11/1993 Anderson et al. .
5,266,340 11/1993 Samson et al. .
5,266,345 11/1993 Corbin et al. .
5,266,763 11/1993 Colombo .
5,288,962 2/1994 Lorence et al. .
5,343,024 8/1994 Prosise et al. .
5,345,069 9/1994 Grindrod .
5,348,751 9/1994 Packer et al. .
5,352,465 10/1994 Gondek et al. .
5,362,504 11/1994 Kamper et al. .
5,389,759 2/1995 Jay et al. .

MICROWAVE COOKING CONTAINER FOR FOOD ITEMS

This application is a continuation, of application Ser. No. 08/570,756 filed Dec. 12, 1995, now abandoned.

BACKGROUND OF THE INVENTION

The present invention relates to a container for cooking a pot pie or similar food item in a microwave oven, and more particularly, to such a container having an advantageously positioned susceptor for cooking and browning pot pies to a desired degree on a consistent basis from oven to oven.

Specially designed packages or cartons for cooking, browning and/or crisping foods in microwave ovens have been used for quite some time. Often, these packages utilize microwave interactive materials which convert microwave energy to heat, to achieve proper or sufficient cooking of the foods contained in the packages. By way of example, U.S. Pat. No. 4,267,420 to Brastad and U.S. Pat. No. 4,641,005 to Seiferth describe the use of various metallized polyester films or susceptors in connection with cooking foods in microwave ovens. In addition, U.S. Pat. No. 4,841,112 to Peleg and U.S. Pat. No. 5,288,962 to Lorence describe other microwavable food packages. However, these prior art packages make use of various complicated and expensive reflective devices designed to shield microwaves from the susceptor material and control the exposure of microwave energy to the food item, or use non-susceptor-lined metal pans for containing the food item such that microwaves only enter through the top of the food item.

In addition, many problems, such as non-uniform browning, overheating or underheating, and the boilingover and soaking into the package of hot gravy, are still experienced in cooking various foods in microwave ovens. Although the use of reflective materials and susceptors have eliminated some of these problems, the design of a package to cook, brown, or crisp particular foods remains a challenge to the microwave package designer.

Indeed, with respect to pot pies in particular, there has not been an economically viable package that provides the desired level of microwave cooking and browning on a consistent basis, especially given the differences in cooking characteristics from oven to oven. As a result, most of the microwavable pot pies currently on the market require that the pot pie be removed from the package before cooking it in the microwave. This creates added preparation time and inconvenience for the consumer. In addition, additional time is required to clean the contents of the food item that boils-over and onto the microwave oven. Furthermore, because the food item is cooked outside the package, the probability of burning the consumer during removal of the cooked food item is dramatically increased.

Accordingly, it will be understood that there is a need for an improved and reliable container for cooking a pot pie, or similar food article, in a microwave oven, such that the pot pie is cooked and browned to a desired degree on a consistent basis from oven to oven. In particular, there is a need for a microwave cooking container for a pot pie that operates as a single-unit, not requiring the food item to be removed from the package prior to cooking. In addition, there is a need for a microwave cooking container for a pot pie that does not rely on complicated and costly reflective devices to control the exposure of microwave energy to the pot pie.

SUMMARY OF THE INVENTION

The present invention is directed to a container for cooking a pot pie, or a similar food item, that provides the desired level of microwave cooking and browning on a consistent basis using various types of microwave ovens. More specifically, a susceptor layer, a material which is microwave interactive and which converts microwave energy to thermal energy, is positioned above a susceptor-lined pan for containing a food item. The arrangement and configuration of the susceptor layer and pan provides for the cooking and browning of a pot pie to a desired level which is both aesthetically and palatably pleasing. This uniform cooking and browning of pot pies has not been satisfactorily achieved heretofore by using either conventional cartons or by cooking the pot pie without the use of a carton or package other than a conventional pan.

The invention container is advantageously provided as a single-unit that does not require the removal of the food item from the transporting container prior to cooking, which results in the increased ease of transportability and preparation. The invention container also provides the advantages of reducing or eliminating the risk of burns to the consumer, and the advantage of not permitting the food contents to boil-over onto the microwave oven, thus requiring clean-up time.

Other features and advantages of the invention will become apparent from the following detailed description taken in conjunction with the accompanying drawings, which illustrate, by the way of example, the principles of the invention.

BRIEF DESCRIPTION OF THE DRAWINGS

The accompanying drawings illustrate the invention. Specifically.

DESCRIPTION OF THE PREFERRED EMBODIMENTS

Figure 1:
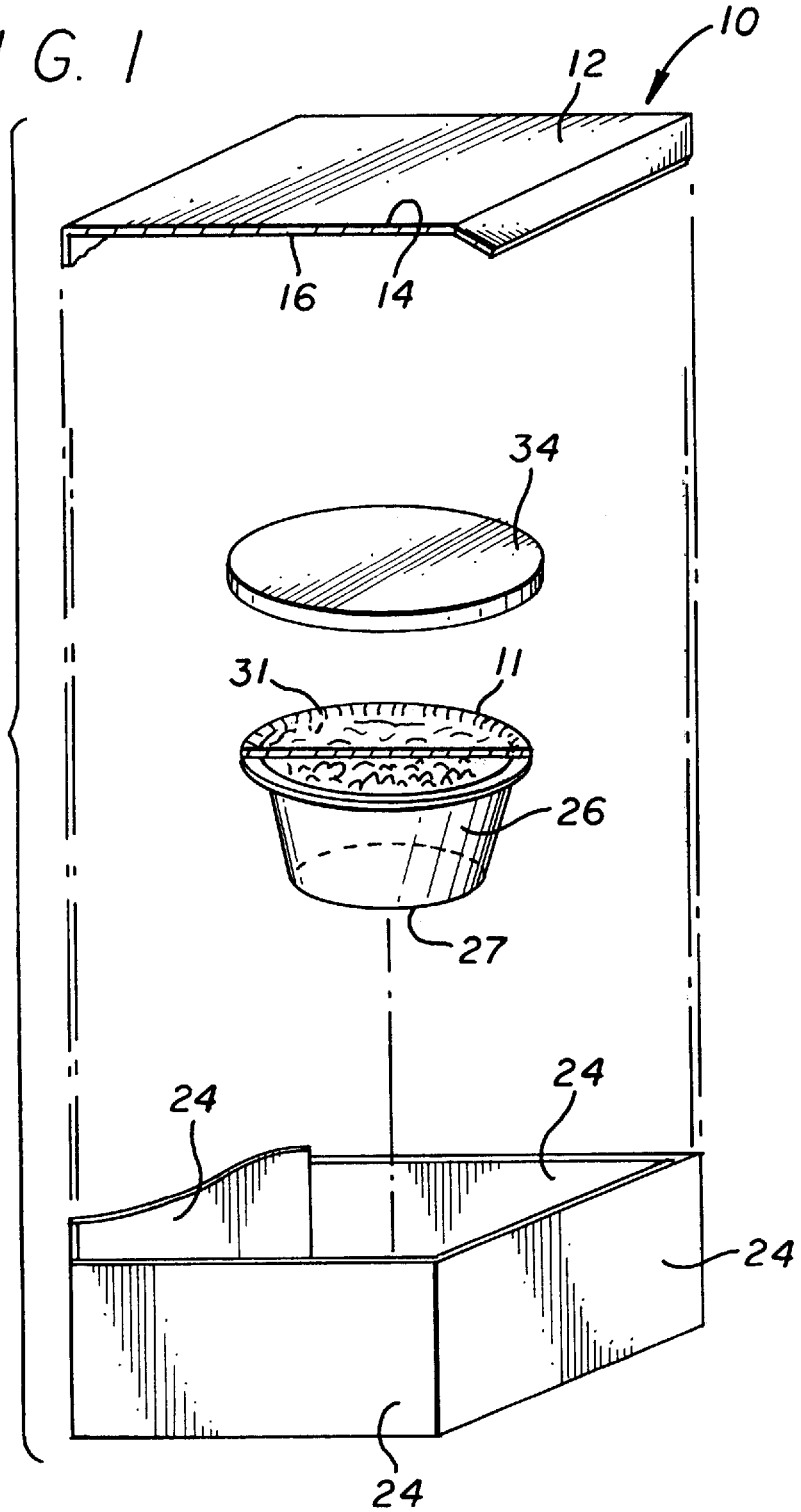
FIG. 1 is an exploded, perspective view of the container of the present invention showing the susceptor, the susceptor-lined pan and the cross-section of a pot pie in the pan.
Figure 2:
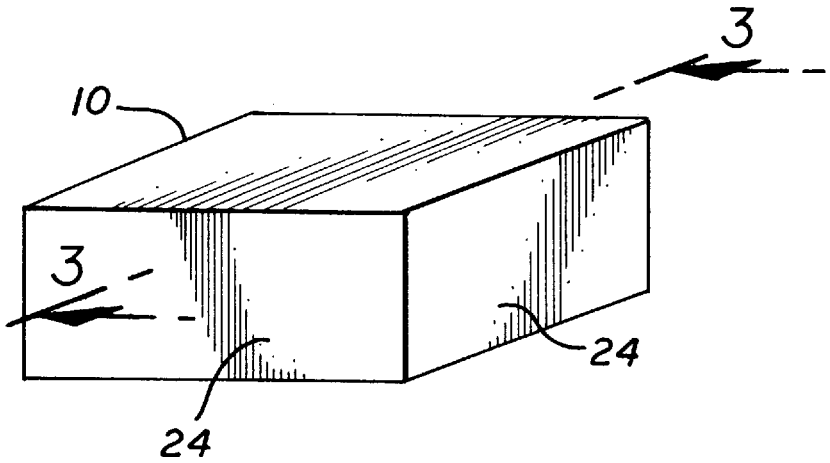
FIG. 2 is a drawing of the container showing the plane of the perspective view of FIG. 1.
Figure 3:
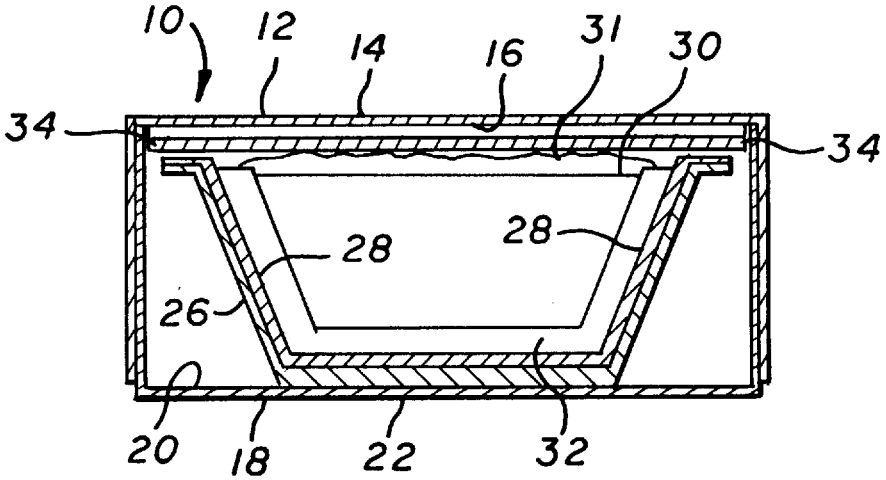
FIG. 3 is a cross-sectional view of the container of FIG. 1, showing the susceptor and the pan.

A disposable container 10 for cooking and browning a pot pie 11 or similar food item, such as a calzone, in a microwave oven is shown in FIGS. 1–3 of the accompanying drawings. With particular reference to FIG. 1 of the drawings, the container 10 has a top panel 12 having an upper surface 14 and a lower surface 16, and a bottom panel 18 having an upper surface 20 and a lower surface 22. The container 10 also has a support structure for maintaining the top panel in an elevated position relative to the bottom panel 18, such as four side walls 24 as shown in the drawings. Paper or paperboard material commonly used for food packaging (such as those made from unitary blanks) is generally suitable for use with the present invention. For example, the present invention may make use of a container with approximate dimensions of 5⅛"×2¼"×5⅛", of 16 point (or 16/1000 of an inch thick) solid bleached sulfate paper (SBS). However, this size container is described by way of example only, and it should be understood that many other suitably sized and shaped structures can be used for supporting the arrangement of susceptors and pans. The container 10 not only provides a highly advantageous cooking structure but serves as part of the transporting packaging that would otherwise be required to store, ship and handle the food item. Another advantage provided by the invention container is that by varying the height of the container, it is possible to control how high the upper dough layer of a pot pie rises (domes), so that large air pockets within the pie are avoided.

As shown in FIGS. 1 and 3, a pan 26 for containing a pot pie 11 (FIG. 1) is situated between the top 12 and bottom 18 panels of the container 10. The inner layer or lining 28 of the pan 26 immediately adjacent the pot pie 11 includes a susceptor material. As shown in the drawings, a typical frustoconically shaped pot pie pan 26 with a circular bottom 27 and transverse cross-section has been found to be suitable for use with the present invention. The susceptor-lined pan made by Pressware Co. of Columbus, Ohio a division of Tenneco Packaging Co. is particularly suitable for use with the present invention. Use of a susceptor-lined pan advantageously permits microwave energy to enter the food item from all directions, as opposed to prior art metal pans, which only permit microwave energy to enter through the top of the food item.

Susceptors, as they are generally referred to, are well known in the art and are devices which convert microwave energy to thermal energy. Typically, susceptors include a thin layer of microwave interactive material, such as aluminum, deposited on a substrate, such as polyester film, by vapor vacuum deposition or other means. Portions of the substrate may be demetallized in a particular pattern to provide stability to the susceptor and a specific heating response. The substrate with the microwave interactive material is usually further attached to a paper or paperboard backing. Examples of these types of susceptors are generally described in U.S. Pat. No. 4,641,005 to Seiferth and U.S. Pat. No. 4,267,420 to Brastad. However, other types of susceptors that have been proposed may be suitable for use with the present invention, including printed ink susceptors, such as those described in U.S. Pat. No. 5,132,144, as well as foil-based susceptors, such as described in U.S. Pat. Nos 4,963,424 and 5,039,364.

With reference to FIGS. 1 and 3, the present invention is particularly directed to a container 10 having a susceptor layer 34 specially arranged inside the container such that the container selectively cooks and browns the pot pie 11 in the pan 26 to the degree most pleasing to consumers and consistent with pot pies cooked in conventional ovens. More specifically, a susceptor layer 34 is positioned between the lower surface 16 of the top panel 12 and the upper surface 31 of the upper dough layer 30 of the pie 11.

As mentioned above and as shown in FIGS. 1 and 3, a susceptor layer 34 is positioned above the upper dough layer of the pie. The susceptor layer 34 is at least as large in area as that of the innermost half of the upper dough layer of the pie (i.e., at least about 2"). The susceptor 34 is capable of absorbing the microwave energy passing through the top of the container and converting it to heat for cooking and browning the pot pie 11. Although the susceptor 34 as shown in the FIGS. is positioned immediately adjacent the upper dough layer 30 of the pie 11, it should be understood that it can be spaced from but preferably aligned with the upper dough layer 30, and that additional layers of microwave transmissive material can be placed between the upper dough layer and susceptor, or between the top panel and the susceptor. In addition, the susceptor layer 34 can be permanently adhered to the lower surface 16 of the top panel 12. Thus, the terms "below" or "above" or "adjacent" are used herein to give the relative position or location of a susceptor or layer in relation to another panel or layer, and are inclusive as to whether they are contacting one another, spaced from one another, or have additional layers in between one another.

It has been found that this configuration of the susceptor layer 34 in conjunction with the susceptor tray results in the optimum cooking and browning of the food item or pot pie 11. For a standard size pot pie (as described above) , an exemplary susceptor layer can have either a circular or square configuration. Preferably, the susceptor layer has a circular configuration and has a diameter in the range of about 2½" up to about 5", with about 4⅞" in diameter being especially preferred. In an alternative embodiment, the susceptor layer can have a square configuration (e.g., in the range of about 5"×5").

For optimum cooking and browning, the susceptor layer is preferably further aligned with the pan 26 (and, hence, the food item in the pan). In this regard, for a typical pot pie and pan having a circular bottom, the susceptor layer should be circular and preferably aligned with the circular bottom 27 of the pan 26, such that they share a common imaginary axis through their centers.

The arrangement of the susceptor layer 34 with respect to the pan 26 provides for the desired cooking and browning of the pot pie 11 that has heretofore not been satisfactorily achieved by conventional microwave pot pie pans or microwave packages without the use of elaborate and costly microwave reflective devices. Thus, it is believed that this particular arrangement allows the microwave energy to impinge upon the susceptors (including the susceptor in the pan) and the pot pie 11 to sufficiently cook and brown the pot pie to the degree that consumers would expect using a conventional oven. It is also believed that this arrangement permits the microwave energy to impinge at particular areas of the susceptor layer 34 and pot pie pan 26 to provide heat and/or microwave energy where needed to enhance the cooking and browning of the pot pie 11.

In certain pot-pie embodiments, it may be desirable to vary the dough thickness for the different layers of dough surrounding the contents of the pie (see, e.g., U.S. Pat. Nos. 4,917,907; 4,448,791; 5,194,271, and the like). Suitable bottom-dough layer 32 thicknesses that may be employed are well-known in the art and are, for example, in the range of about 1 mm (≈1/32") up to about 5 mm (≈3/16"), and even up to about 10 mm (⅜"). Preferred dough thicknesses are about 1 mm up to about 3 mm in width.

In preferred embodiments of the present invention where pot-pies are employed, browning agents are used to provide brown coloration similar to that obtained by cooking in a conventional oven. Suitable browning agents for use herein are well-known in the art and include, for example, those agents that undergo a chemical change and turn brown during the cooking process, as well as brown colorants that remain the same color during the cooking process (see, e.g., U.S. Pat. Nos. 5,118,514; 5,089,278; 5,043,173; 5,968,522; and 4,735,812; all of which are incorporated by reference in their entirety). These agents can be applied to the upper surface 31 of the upper layer of dough 30 after the food item is in the pan or can be mixed into the dough prior to preparing the food item. Especially preferred for use with invention potpies are browning agents that can be applied to the upper surface 31 of the upper layer of dough 30 after the food item is in the pan described in, for example, U.S Pat. Nos. 5,292,541; 5,397,582; and the like (each of which is incorporated by reference in its entirety).

By way of example, the container 10 of the above-described embodiment of the present invention is suitable for cooking and browning to the desired degree a chicken pot pie weighing about 10 oz. in a 650 watt microwave oven on high for approximately 7 to 9 minutes. A pot pie cooked under these conditions will be fully cooked and browned to the degree generally desired by consumers.

In an alternative embodiment, the container 10 of the above-described embodiment of the present invention is suitable for cooking and browning to the desired degree a chicken pot pie weighing about 17 oz. and has the approximate dimensions of 5¾"×2½"×5¾". The susceptor disk in this particular embodiment is approximately 5¼" in diameter. Such a pot pie is cooked in a 650 watt microwave oven on high for approximately 10–13 minutes.

It has been found that the aqueous contents of the food item may boil over from time to time and soak into the bottom panel 18 of the container 10, thereby causing the pan to stick to the inside of the container and/or causing the container to stick to the inside of the microwave oven. To prevent such an event, the present invention contemplates applying a suitable microwave transparent barrier (e.g., a release-coating, lamination or extrudate) to the upper surface 20 of the bottom panel 18 of the container 10 that functions to prevent hot aqueous material (e.g., gravy, sauce, and the like) from soaking into the container.

Suitable barriers can be applied to the upper surface 20 of the bottom panel 18 of the container 10, and include, for example, water-based acrylic coatings, various extrudable polyesters (such as those available from Eastman Chemical Co.), polypropylenes, polyethylenes, and the like. Additional release-coatings that may be employed herein include those described in U.S. Pat. application Ser. No. 08/092,268, now U.S. Pat. No. 5,573,69 (incorporated herein by reference in its entirety). Such coatings or extrudates can be applied to the entire inside surface of the bottom of the container, or can be free films that are laminated or windowed onto the inside surface of the bottom of the container. Alternatively, during production of the container, the paperboard can be treated (as is well-known in the art) with board-sizings, flourocarbons, clay-coatings, or treated with any material that will function as a barrier to repel hot aqueous material, such as gravy and/or sauce.

In addition, to reduce the occurrence of the food contents boiling-over, a variety of gums (i.e. thickening agents) well-known in the art can be advantageously employed in the food item (e.g., pot pie). Gums suitable for use herein are those that function to maintain the viscosity of the food contents at levels that reduce or eliminate boiling-over when the food contents are heated (such as in a microwave) . For example, gums supplied by Dow Chemical Co. are suitable for use in the invention food items (see, e.g., U.S. Pat. No. 4,915,970, and the like). A particularly preferred gum is a methylcellulose. Such gums are provided in, for example, a pot pie at a concentration in the range of about 0.01% up to about 10% by weight of the total food content, more preferably in the range of about 0.05% up to about 5%, with 0.1% up to about 0.5% by weight of total food content being especially preferred.

In another embodiment, the cooking container of the present invention employs a susceptor-lined pan without having a susceptor layer positioned above the pan. It has surprisingly been found that this particular configuration of the present invention also provides for the selective and consistent cooking and browning of pot pies or similar food items. However, in the embodiments where a susceptor layer is not used above the upper-dough layer 30 of the food product, the upper-dough layer may rise and stick to the lower surface 16 of the upper panel 12, thereby leaving part of the crust stuck to the container upon removal.

To prevent such an occurrence, the present invention contemplates applying a suitable microwave transparent barrier that functions to prevent the upper dough layer from sticking to the container to the lower surface 16 of the upper panel 12 of the container 10. Suitable barriers that can be applied to the lower surface of the upper panel of the container 10 include, for example, those described above. Such barriers can be applied to the entire inside surface of the top panel of the container, or can be free films that are laminated or windowed onto the inside surface of the top panel of the container.

In a further embodiment of the present invention, one of the above-described coatings, laminations or extrudates is applied to the entire inner surface of the container.

All U.S. Patent publications referred to herein are hereby expressly incorporated by reference in their entirety. While particular forms of the invention have been illustrated and described, it will be apparent that various modifications can be made without departing from the spirit and scope of the invention. Accordingly, it is not intended that the invention be limited, except as defined by the appended claims.

I claim:

1. A container for cooking and browning a pot pie in a microwave oven, comprising:

a container having a top panel, a bottom panel and a supporting structure for maintaining said top panel in an elevated position relative to said bottom panel;

a pot pie for cooking and browning having an upper dough layer;

a pan containing the pot pie, the pan positioned in the container between the top and bottom panel and having a susceptor lining for converting microwave energy to thermal energy for cooking and browning the pot pie; and a susceptor layer positioned in contact with the upper dough layer of the pot pie, such that the susceptor layer is located between the top panel of the container and the upper-dough layer of the pot pie, wherein said container does not have any microwave reflective device therein, and whereby the container provides for the selective cooking and browning of the pot pie when cooked in the container.

2. The container of claim 1, wherein the area of the susceptor layer is at least as large as that of the circumference of the bottom of the susceptor-lined pan.

3. The container of claim 1, wherein the supporting structure for maintaining said top panel in an elevated position relative to said bottom panel is comprised of four side walls.

4. The container of claim 1, wherein said container has a barrier for preventing hot aqueous material from soaking into the container on the upper surface of the bottom panel of said container.

5. The container of claim 1, wherein said container has a barrier for preventing hot aqueous material from soaking into the container on the entire inner surface of said container.

6. The container of claim 1, wherein the susceptor is circular.

7. The container of claim 6, wherein the area of the susceptor layer is at least as large as that of the circumference of the bottom of the susceptor-lined pan.

8. The container of claim 7, wherein the diameter of the susceptor is selected from about 3, about 4 or about 5 inches in diameter.

9. The container of claim 8, wherein the susceptor is about 4⅞ inches in diameter.

10. The container of claim 9, wherein the pan has a circular bottom which is concentrically aligned with the susceptor for optimum cooking and browning of the pot-pie.

11. The container of claim 1, wherein the pot pie has a browning agent on the top surface of an upper-dough layer.

12. The container of claim 1, wherein the pot pie has a bottom-dough layer thickness in the range of about 1/32" up to about 6/32".

13. The container of claim 12, wherein the pot pie has a bottom-dough layer thickness in the range of about 1/32" up to about 3/32".

14. The container of claim 1, wherein the susceptor layer is not adhered to the top panel.

* * * * *